US009288568B2

(12) United States Patent
Boyajian et al.

(10) Patent No.: US 9,288,568 B2
(45) Date of Patent: Mar. 15, 2016

(54) HEADPHONE SYSTEM FOR EARBUD SPEAKERS

(71) Applicants: Adam G. P. Boyajian, Upper Saddle River, NJ (US); Michael O. Parelli, Greenwich, CT (US); Eric A. Knight, Unionville, CT (US)

(72) Inventors: Adam G. P. Boyajian, Upper Saddle River, NJ (US); Michael O. Parelli, Greenwich, CT (US); Eric A. Knight, Unionville, CT (US)

(73) Assignee: ADVANCED AUDIO LLC, Greenwich, CT (US)

( * ) Notice: Subject to any disclaimer, the term of this patent is extended or adjusted under 35 U.S.C. 154(b) by 125 days.

(21) Appl. No.: 14/243,887

(22) Filed: Apr. 2, 2014

(65) Prior Publication Data

US 2014/0211959 A1 Jul. 31, 2014

Related U.S. Application Data

(63) Continuation-in-part of application No. 13/571,147, filed on Aug. 9, 2012.

(60) Provisional application No. 61/807,728, filed on Apr. 2, 2013, provisional application No. 61/530,572, filed on Sep. 2, 2011.

(51) Int. Cl.
*H04R 1/10* (2006.01)
*H04R 5/033* (2006.01)

(52) U.S. Cl.
CPC ..... *H04R 1/1075* (2013.01); *H04R 1/1041* (2013.01); *H04R 5/033* (2013.01)

(58) Field of Classification Search
None
See application file for complete search history.

(56) References Cited

U.S. PATENT DOCUMENTS

| | | | | |
|---|---|---|---|---|
| 4,472,607 | A | 9/1984 | Houng | |
| 7,292,704 | B2 | 11/2007 | Lederer | |
| 7,680,267 | B2 | 3/2010 | Bradford et al. | |
| 2005/0147269 | A1 | 7/2005 | Oliveira et al. | |
| 2007/0025581 | A1 | 2/2007 | Bradford et al. | |
| 2008/0298626 | A1 | 12/2008 | Dean | |
| 2009/0226024 | A1 | 9/2009 | Dean | |
| 2009/0323975 | A1* | 12/2009 | Groesch | H04R 5/033 381/71.1 |
| 2011/0170731 | A1* | 7/2011 | Beckhart | H04R 1/105 381/381 |
| 2011/0206215 | A1 | 8/2011 | Bunk | |
| 2012/0093351 | A1* | 4/2012 | Amsel | H04R 1/025 381/378 |
| 2013/0156247 | A1* | 6/2013 | Boyajian | H04R 1/105 381/370 |

FOREIGN PATENT DOCUMENTS

| | | | |
|---|---|---|---|
| JP | 8047075 | A | 2/1996 |
| WO | WO 2007/095572 | A2 | 8/2007 |

* cited by examiner

*Primary Examiner* — Thang Tran
(74) *Attorney, Agent, or Firm* — Wasserbauer Law LLC; Damian Wasserbauer, ESQ.

(57) ABSTRACT

The present invention relates to a personal headphone device, system and method configured to combine a headphone and earbud into one acoustical product. The headphone earbud device is configured with an adaptive connection for controlling the audio signals and/or device providing the audio signals. The adaptive connection includes an electro mechanical and/or mechanical connection so that when an earbud is placed into a headphone contact plates on the earbud mate with contact plates on the interior recess of the headphone so as to energize a loudspeaker in the headphone and or to control the device providing the audio signals.

20 Claims, 4 Drawing Sheets

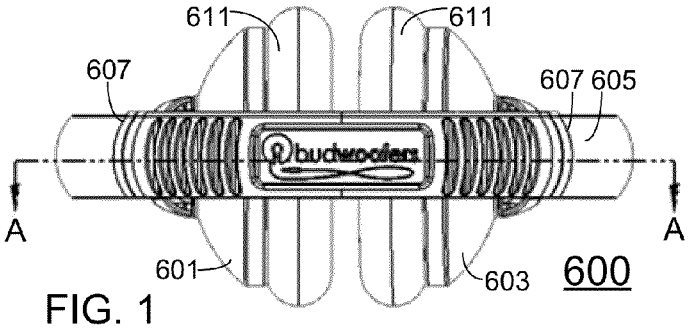
FIG. 1
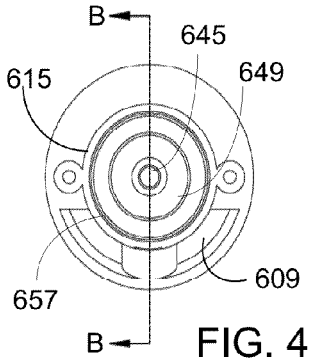
FIG. 4
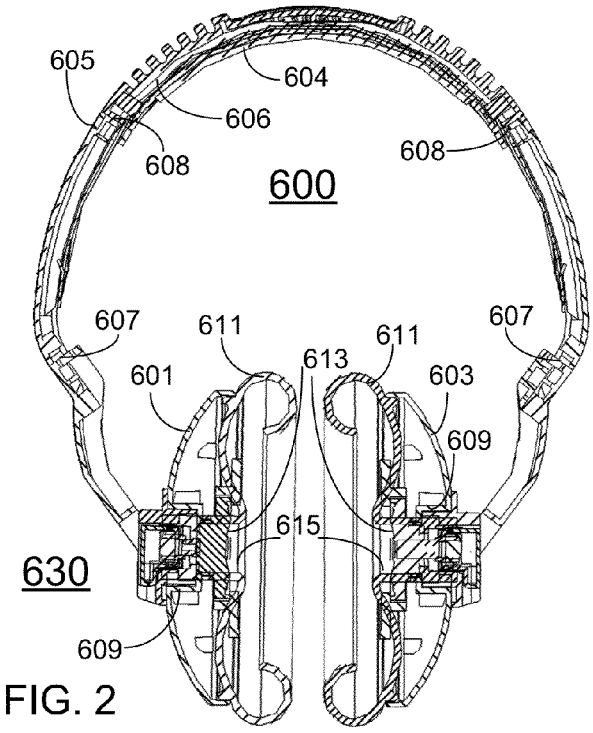
FIG. 2
FIG. 5
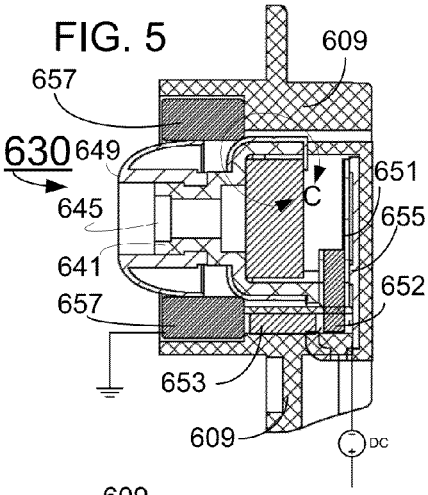
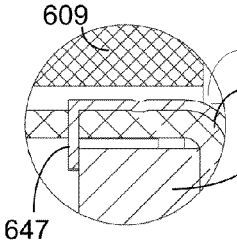
FIG. 6
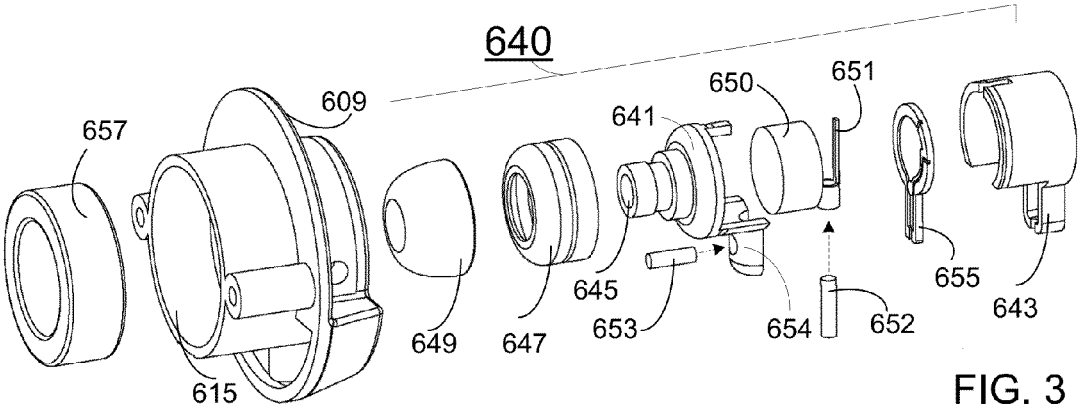
FIG. 3

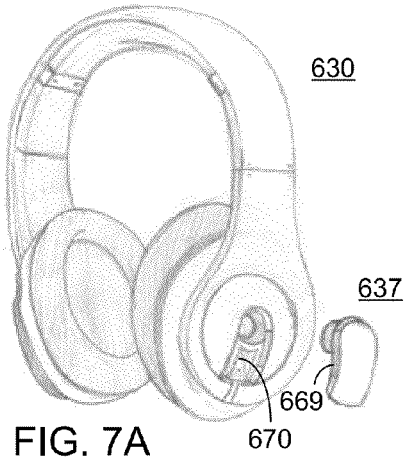
FIG. 7A
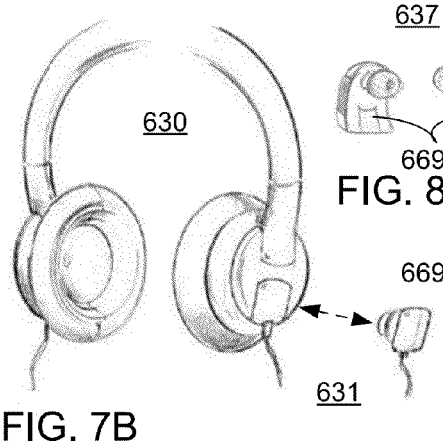
FIG. 7B
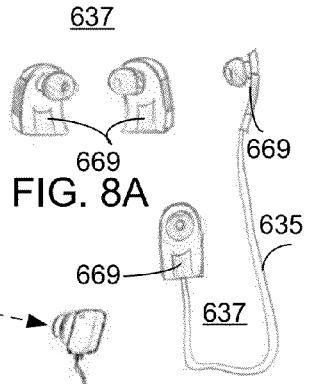
FIG. 8A
FIG. 8B
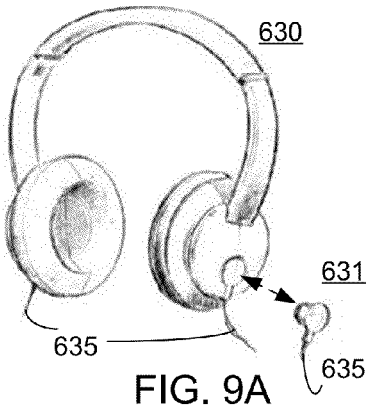
FIG. 9A
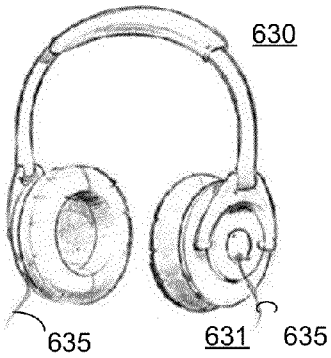
FIG. 9B
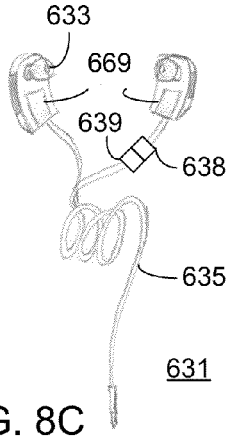
FIG. 8C
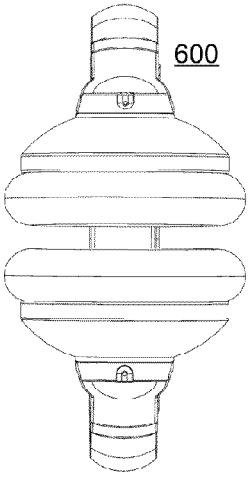
FIG. 10
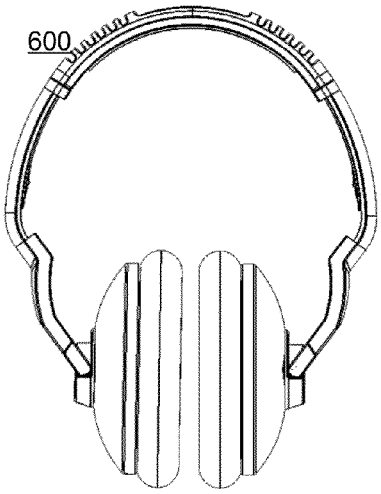
FIG. 11
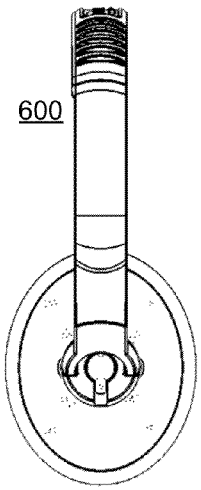
FIG. 12
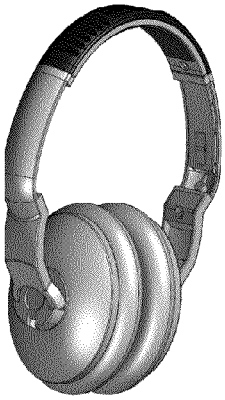
FIG. 13

HEADPHONE SYSTEM FOR EARBUD SPEAKERS

CROSS-REFERENCE TO RELATED APPLICATIONS

This application claims priority under 35 U.S.C. section 119 and the benefit of Provisional Patent Application No. 61/807,728 filed on Apr. 2, 2013, which is a continuation-in-part of application Ser. No. 13/571,147, filed Aug. 9, 2012, now U.S. Published Patent Application US20130156247 A1, which claims priority of Provisional Patent Application No. 61/530,572 filed on Sep. 2, 2011.

FIELD OF THE INVENTION

The present invention is in the field of personal audio, headphones and earbuds, and more particularly, the field of hybrid headphone systems combining headphones and earbuds into one acoustical product with an adaptive connection of an earbud to a headphone. Earbuds include the in-ear headphones variety.

BACKGROUND OF THE INVENTION

Earbud and headphone-style devices are used to play audio for users of electronic devices with media playback capabilities. Earbud-style devices are fitted adjacent the ear, for example, a small plastic earpiece rests in the outer ear canal, or alternatively having an elastomeric earpiece(s) that fits snuggly within a user's ear canal. Headphone-style devices have relatively large ear cups that are worn over the ears placing a loudspeaker adjacent the user's ear. Headphones may be used by a user to play audio of a media player or may handle audio for a cellular telephone.

Headphones are great for their comfort, sound quality, style, and background noise cancellation when the user is stationary. Earbuds are best for their portability, discreteness, and durability when the user is on-the-go. Consumers use both, and commonly switch back and forth between earbuds and headphones throughout the day in a variety of settings.

Conventional earbud systems are compact, easily transportable, useful for users are that are on-the-go, and inexpensive to produce audio devices. Earbuds have disadvantages in that they can be uncomfortable, fall out of the ears, produce less quality sound, and cause more hearing loss/damage. Headphones and earbuds both have disadvantages of their own; headphones can be bulky, overly expensive, difficult to adjust to a perfect fit, and difficult to take on-the-go because of their larger size. Earbuds can have reduced durability and may be easily damaged as they are wrapped around MP3 players, and stuffed in pockets and bags.

SUMMARY OF THE INVENTION

It is an object of the present invention to provide an apparatus, system and method for acoustically amplifying the input audio generated by the earbud audio to the headphone headset either with coupling to a loudspeaker or replacing the ear loudspeaker of the headphone with the input of the earbud.

It is an object of the present invention to provide an apparatus, system and method of improvements in the mechanical/electrical connection between the earbud and headphone.

It is an object of the present invention to provide advantages of the apparatus, system and method of utilizing the earbud and headphone connection to control the user's device including to energize the device to power on and off, raising and lowering the volume, muting and un-muting a microphone, and other features to control the device.

It is an object of the present invention to provide an apparatus, system and method of controlling the functionality of the device utilizing wired earbuds or wireless earbuds, such as Bluetooth earbuds, that detachably connect to a headphone system.

It is yet another object of the present invention to provide an apparatus, system and method of connecting wireless earbuds that when received into the headphone portion turn the headphone system into a wireless headphone system.

It is yet another object of the present invention to provide an apparatus, system and method that provides the user with a more convenient audio solution that advantageously embodies all of the advantages of earbuds and headphones within one device.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein:

FIG. 1 is a top schematic view illustrating the headphone and earbud device, system, and method in accordance with an embodiment of the present invention;

FIG. 2 is a schematic cross-sectional view, taken along lines A-A of FIG. 1, illustrating the headphone and earbud device;

FIG. 3 is an exploded schematic view illustrating the earbud to headphone housing assembly;

FIG. 4 is an end view illustrating the interior and speaker chamber;

FIG. 5 is a schematic cross-sectional view of the earbud to headphone housing assembly, taken along lines B-B of FIG. 4;

FIG. 6 is a schematic cross-sectional view of the earbud to headphone housing assembly, taken along lines C-C of FIG. 5;

FIGS. 7A and 7B are schematic views of the attachment of the earbuds to the headphone assembly;

FIGS. 8A, 8B and 8C are schematic views of the various wireless and wired earbuds according to the present invention;

FIGS. 9A and 9B are schematic views of the attachment of wired earbuds according to the present invention;

FIG. 10 is a bottom schematic view of the design of the headphone and earbud assembly;

FIG. 11 is a front schematic view of the design of the headphone and earbud assembly, which view is the same from the back view;

FIG. 12 is a side schematic view of the design of the headphone and earbud assembly, which view is the same from each side;

FIG. 13 is a side schematic view of the design of the headphone and earbud assembly, which view is the same from each side;

DESCRIPTION OF THE EMBODIMENTS

Figure 14A:
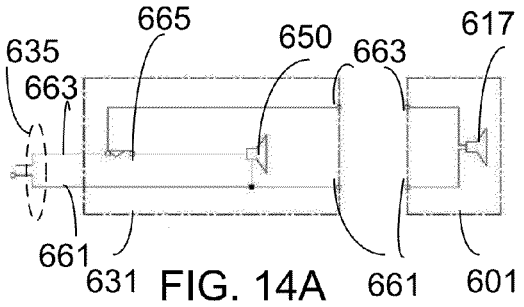
FIGS. 14A and 14B are circuit diagrams of the electronic switch assembly of the headphone and earbud assembly.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "headphone" or "headphones" refers to a pair of earphones, or a single earphone, typically joined by a band placed over the head, for listening to audio signals such as music or speech. Headphones generally have a pair of small loudspeakers, or a single speaker, held close to a person's ears and connected to the audio signal source such as a cellular telephone, smart phone, tablet, computer, radio, audio amplifier, CD player, and/or portable Media Player.

As used herein the term "earbud" or "earbuds" refers to an electrical device consisting of two earphones, or a very small headphone, worn inside the ear. The earbud can be wireless or wire-based to provide the audio signals from the audio signal source.

As used herein the term "magnet" refers to an object made from a material that is magnetized and creates its own persistent magnetic field exhibiting properties of magnetism: a force that pulls on other ferromagnetic materials, such as iron, and attracts or repels other magnets or other iron-containing objects, or aligning itself in an external magnetic field. Magnet can be either a permanent magnet of an object made from a material that is magnetized and creates its own persistent magnetic field, for example, iron, nickel, cobalt, some naturally occurring minerals and alloys of rare earth metals, or an electromagnet that is made from a coil of wire that acts as a magnet when an electric current passes through it but stops being a magnet when the current stops.

As used herein the term "switch" refers to a device for making and breaking the connection in an electric circuit.

As used herein the term "control", "controller", "control device", or "device control" refers to any input device that controls the flow of current in a circuit. Control devices determine when loads are energized or de-energized such as, for example, to energize the device to power on and off, raising and lowering the volume, muting and un-muting a microphone, and other features of the device that can be operated by the user's control.

As used herein the term "microphone" refers to an acoustic-to-electric transducer or sensor that converts sound in air into an electrical signal. Microphones are used in many applications such as, for example, cellular telephone, soft phone, and other telephony devices, tape recorders, and in computers for recording voice, speech recognition, VoIP, and for other acoustic purposes. Microphone can be an electromagnetic induction or dynamic microphone, a capacitance change or condenser microphone, piezoelectric generation microphone adapted to produce an electrical signal from air pressure variations or other sensor that converts sound in air into an electrical signal.

As used herein the term "mute" refers to a circuit function that acts to suppress the audio (or video) output of a receiver or input signal, for example, interrupting or turning off the sound input to a microphone, or the output on a speaker or other audio device; "un-mute" refers to a circuit function that acts to restoring the audio (or video) output of a receiver or input signal, for example, restoring the sound input to a microphone, or the sound output on a speaker or other audio device, having previously muted it.

As used herein the term "volume" refers to circuit function that acts to raise or lower the amplitude of the audio (or video) output of a receiver signal, for example, raising and lowering the volume of the audio signal from the audio device.

As used herein the term "speaker" or "loudspeaker" refers to an electro-acoustic transducer that produces sound in response to an electrical audio signal input, for example, loudspeakers convert electrical signals into audible signals.

Cross-reference guide is being made similar elements of Provisional Patent Application No. 61/807,728, U.S. Published Application No. US20130156247 A1, application Ser. No. 13/571,147 and Provisional Patent Application No. 61/530,572, which claims the benefit of the entire disclosure of these parent and child applications and are hereby incorporated by reference. In this respect, the present invention utilizes similar terms for similar elements, for example, headphone and ear bud device 600 has similar corresponding elements 100, 500 in U.S. Published Application No. US20130156247 A1, as well as a first headphone 601 (101, 501), second headphone 603 (103, 503), headband 605 (105, 505), connector 607 (107, 507), headphone aperture 609 (109, 509), ear cushion member 611 (111, 511), speaker acoustic device 613 (113, 513), speaker chamber 615 (115, 515) as well as earbud device 631 (131, 531), earbud speaker 635 (133, 533) and earbud wire 633 (135, 535). Moreover, the innovative design of the headphone and earbud device and system 600 of the present invention is illustrated in perspective, side(s), top, bottom, front and back views as is shown in FIGS. 10 through 13, respectively.

As illustrated in FIGS. 1 through 22, an embodiment of the headphone and earbud assembly, system and method 600 with improved adaptive mechanical/electrical connection assembly between the earbud and headphone according to the present invention. Referring now to FIGS. 1 and 2, headphone and earbud device 600 includes a first headphone 601 and a near minor second headphone 603. The description of the first headphone 601 may apply equally to the second headphone 603. The first headphone 601 may be connected to the second headphone 603 by a headphone headband 605 which may be substantially U-shaped, adjustable and flexible in order to accommodate varying users head sizes and made comfortable with a utilizing with a headband cushion 604. The headphone headband 605 can comprise a spring steel bow 606, a connector 607 and headband inner and outer holders 608*a*, 608*b* to adjust the first headphone 601 and the second headphone 603, for example, allowing the respective headphone 601, 603 to pivot and/or rotate around pivot at connection 607 to provide a swivel operation and/or to slide at connection 608. Each headphone 601, 603 may include a headphone aperture assembly 609 which can be substantially centered on the exterior surface (distal side) of the headphone 601, 603. The headphone 601, 603 may include an ear cushion member 611 which may be a elongated flexible ring to cushion member 611 of the headphone 601, 603 from the ear of the user. The headphone 601, 603 can be configured to include a speaker acoustic device 613 and/or a speaker chamber 615 which may be dome shaped, each cooperating with ear cushion member 611 to provide quality audio signals to the headphone.

Generally, the earbud device 631 is inserted into the headphone aperture assembly 609 as is shown in FIGS. 7A and 7B, and 9A and 9B. Accordingly, as is illustrated in FIG. 3 an headphone earbud assembly 630 is configured with an earbud device 631 is generally configured with an earbud speaker 633 that is part of the earbud driver unit 650. An earbud wire 635, which may be flexible, provides an audio signal electronically to the earbud speaker 633, as is shown in FIG. 8C. The earbud wire 635 can include a microphone 638 for the input of audio signals to the attached device such as a mobile telephone, tablet and the like, as is shown in FIG. 8C. The earbud wire 635 can also include a control 639 for controlling the attached device such as, for example, adjust the relative volume of the audio, energizing the device includes turning the power on and off, e.g. press and hold for more than one second and to mute and un-mute the microphone, e.g. tap when power is on to turn the microphone on and off, as is shown in FIG. 8C. The earbud device 631 can be wireless 637 such as through a Bluetooth protocol, as illustrated in FIGS. 8A and 8B, so as to provide an audio signal electronically to the earbud speaker 633, which can include the microphone 638 and control 639 for controlling the attached device generating an audio source as shown in FIG. 8C. For example, to control the device including muting and un-muting, raising the volume, or providing other controlling of the device.

According to an embodiment of the present invention, the mechanical/electrical connection between the earbud and headphone is illustrated in FIGS. 1-18A and 18B. The earbud speaker 633 may cooperate with the headphone aperture assembly 609 to achieve a detachable connection for example by a friction fit or by magnetic clip and the like to form a mechanical/electrical connection. The connection 660 described here in creates an electrical and/or electromechanical switch 665 that when in proximity/contact with the headphone, controls the activation thereof so as to turn the earbud off, while simultaneously sending the audio signal to the headphones—turning them on.

Figure 14B:
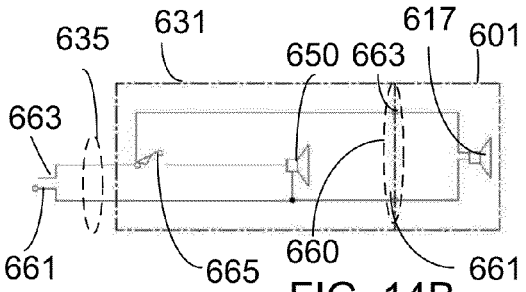

As is illustrated in FIG. 3, the earbud device 631 is adapted with a connection assembly 660 according to the present invention as such circuit is shown in FIGS. 14A and 14B. Referring to FIG. 3, the connection assembly 660 can be electrical, mechanical, or electro-mechanical and comprises an earbud assembly 640 having a general ergonomic and stylish design, durable sweat-resistant construction and built to withstand the extremes everyday wear. The earbud assembly 640 comprises a front chassis portion 641 and a rear chassis portion 643. The front chassis portion 641 includes a nozzle 645 adapted for the output of audio signals, whereby nozzle 645 provides a primary output opening, that outputs sound from the earbud speaker housed in a driver unit 650 (shown generally) in the cassis to the ear canal, see FIGS. 3, 4, 5 and 6. The rear chassis portion 643 is configured to create acoustic waveforms and to accept and protect earbud wires 635, as such wires 635 are shown in FIGS. 7B, 8B, 8C, 9A and 9C. The front and rear chassis portions 641 and 643, respectively, can be configured acoustically to maximize audio fidelity and desired performance from the earbud device 631. The front and rear chassis portions 641 and 643 can be secured with seal 647 adapted to keep moisture and elements from the internal portion of the chassis.

As illustrated in FIGS. 3, 4, 5 and 6, and FIGS. 18A and 18B, the earbud assembly includes a connection assembly having active parts of the doughnut magnet 657 attracts the seal 647 of the earbud 631 to connect thereto magnetically, a beryllium copper magnet holder 651, magnet 652 configured to be disposed in vertical orientation in the holder 651, magnet 653 oriented transversely through hole 654 in front chassis portion 641, and a printed circuit board 655 adapted as a switch to connect and disconnect the earbud speaker of the driver unit 650 so as to control and energize the loudspeaker 617 of the headphone and earbud device, system and method 600 of the present invention. The printed circuit board 655 operates as a switch between the positive lead 661 and the earbud speaker in drive unit 650 and the loudspeaker 617 of the headphones 601, 603. The headphone 601, 603 loudspeaker(s) 617 can be energized by the operation of the doughnut magnet 657 that can be energized by the operation of the doughnut magnet 657 making a connection to the seal 647 that now attracts and connects magnet 653 and attracts magnet 652 and beryllium copper magnet holder 651 to disconnect the positive lead from the printed circuit board 655 and apply it to the circuit of the loudspeaker 617 of the headphone(s) 601, 603.

In accordance with the adaptive connection assembly 660 of the present invention, the seal 647 is made of suitable electrically conductive metal to form a circuit of FIGS. 14A and 14B as well as made of suitable magnetically attractive material to attract and hold the seal 647, as well as a beryllium copper magnet holder or clip contact 651, magnet 652 configured to be held within beryllium copper magnet holder 651 magnet to a doughnut magnet 657 in the housing of the headphone aperture assembly 609 as shown in FIGS. 3, 4, 5 and 6. A sleeve 649, for example, a generally bullet-shaped sound isolating earbud sleeve 649 according to the present invention is shown although a variety of other shapes are contemplated.

As shown in FIGS. 3, 4, 5 and 6, the driver unit 650, essentially the earphone speaker, is adapted to convert electrical audio signals to audible air signal in a known way using a diaphragm, magnets and coils. The driver unit 650 receives the electrical audio signals from the earbud wire 635 or wireless 637 connection to the audio or other device. Accordingly an earbud device 631 can function advantageously either with wired earbuds (FIG. 8C), or wireless earbuds (FIGS. 7A, 8A and 8B) that detachably connect to the headphone and earbud device 600 system and method of the present invention.

Figure 18A:
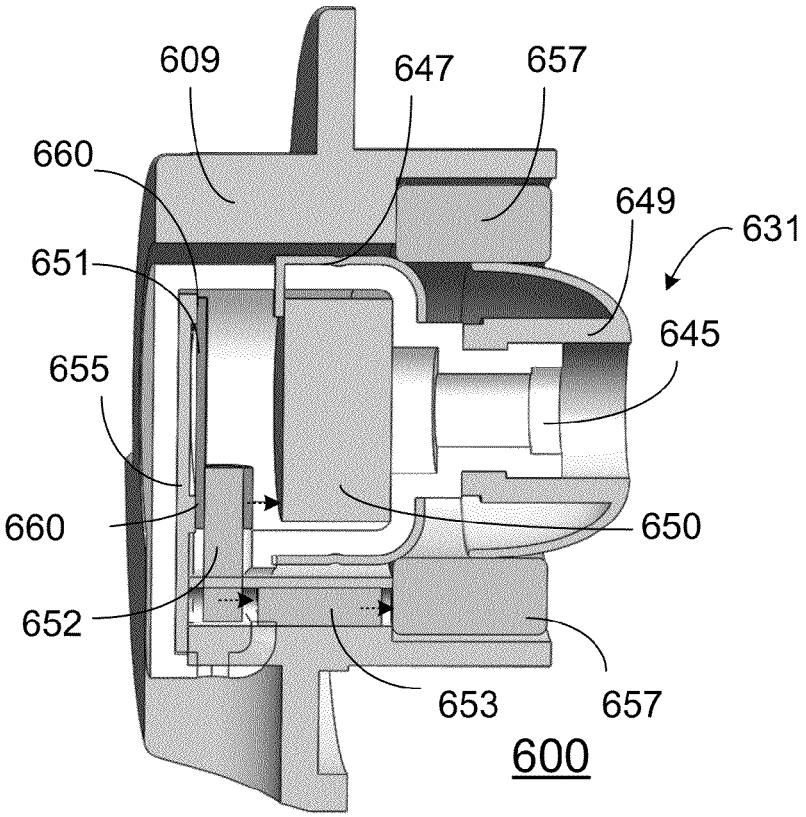
FIG. 18A illustrates an earbud connection position and FIG. 18B a headphone connection postion of the headphone and earbud design according to the present invention.
Figure 18B:
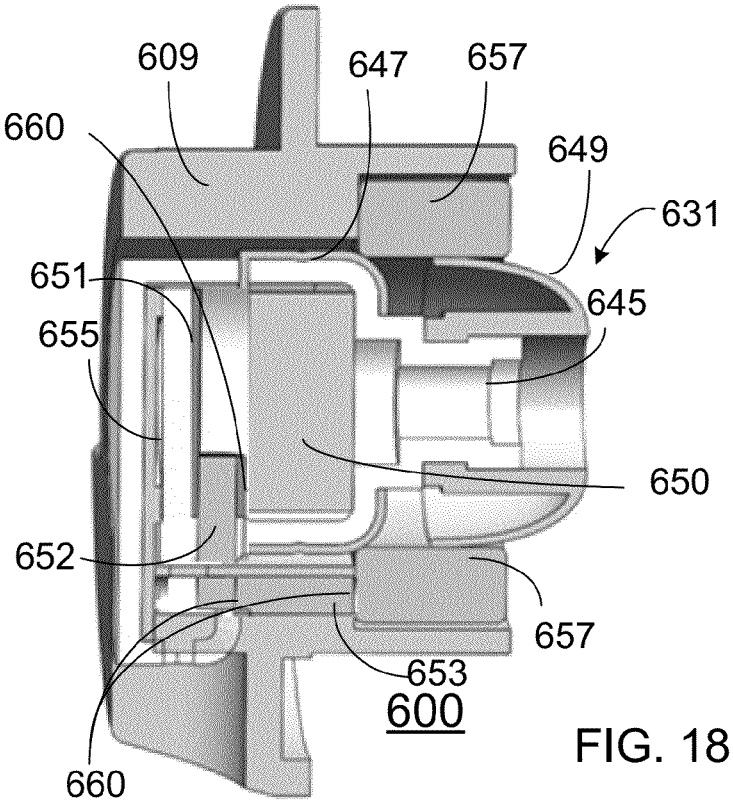

According to an embodiment of the present invention, as shown in FIGS. 18A and 18B, the connection assembly 660 between a headphone, for example, first headphone 601 or second headphone 603, or both, and the earbud device 631 can be configured to control and energize a loudspeaker 617 in the headphone 601. The earbud wire 635 supplying the audio signal via a positive wire 661 and a negative wire 663 or alternatively a positive signal line and a ground line, whichever polarity is desire. According to the present invention, the polarity is positive such that when the doughnut magnet 657 in the assembly 609 of the headphone 601 attracts the metal seal 647, it connects the signal to the ground, breaking the earbud 631 contact with the beryllium copper magnet holder 651 and the printed circuit board 655, thereby operating as a switch 665 forming a connection line through loudspeaker 617 in the headphone 601 to ground, as is shown in FIGS. 14A and 14B and FIGS. 18A and 18B.

In operation, referring to FIG. 18A, placing the earbud 631 in the headphone aperture assembly 609 positions the doughnut magnet 650 adjacent the seal 647, whereby the doughnut magnet 657 is part of the electrical circuit being connected thereto to ground and the seal 647 is constructed of conductive metal attracted to the doughnut magnet 657. The magnet 653 is positioned transversely in a hole 654 of the headphone aperture assembly 609 adjacent the doughnut magnet 657 and adjacent the magnet 652. Magnet 652 is positioned within a beryllium copper magnet holder 651 which is a clip contact that interacts to form a circuit with the printed circuit board 651. Magnets 652 and 653 are similar and arranged in a polarity to attract to each other and to attract to the doughnut magnet 657. Referring to FIG. 18B, the attractive forces of the doughnut magnet 657 upon the magnet 653, magnet 652 and beryllium copper magnet holder 651 pulls the holder 651 away from the printed circuit board 655 thereby disconnecting from the earbud speaker/driver unit assembly 650 and connecting to the loudspeaker of the headphone 601. In this manner the objects and advantages of the present invention to turn the headphone system, whether wired or a wireless headphone system, and to provide the user with a more convenient audio solution that advantageously embodies all of the advantages of earbuds and headphones within one device to enjoy the improved fidelity According to an embodiment of the present invention, as shown in FIGS. 14A and 14B, the connection assembly 660 between a headphone, for example, first headphone 601 or second headphone 603, or both, and the earbud device 631 can be configured to control and energize a loudspeaker 617 in the headphone 601. The earbud wire 635 supplying the audio signal via a positive wire 661 and a negative wire 663 or alternatively a positive signal line and a ground line, wherein the earbud wire 635 conveys audio signals for the at least one speaker driver from the audio connector to the at least one earbud. The connection 660 can be configured as an electrical connection between the earbud device 631 and the headphone 601, for example, as electrical connection, mechanical or an electro mechanical connection to control and/or energize the device connected to the earbud device 601. As is illustrated in FIGS. 14A and 14B, an electrical circuit connects the audio signal along the positive wire 661 to the speaker or driver unit 650 of the earbud device 631 with a return negative wire 663. When connection 660 is made between the earbud 631 and the headphone 601, the switch 665 opens and the audio signal is provided to headphone speaker 617, as is shown in FIG. 14B. In this manner, the connection 660 of the earbud 631 to the headphone 601 can control advantageously the headphone and earbud device 600.

Figure 15:
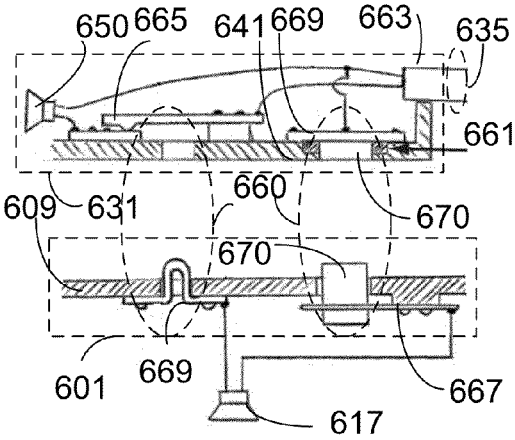
FIG. 15 is a schematic circuit diagram of the electronic switch assembly of an embodiment of the headphone and earbud assembly.

According to an alternative embodiment of the present invention as shown in FIG. 15, the connection 660 can be formed by an electro-mechanical connection configured with a leaf spring contact 667, such as can be formed from spring steel, configured in the earbud device 631, a metal contact 669 such as a metal or conductive plate, and one or more magnets 670 such as a permanent magnet. An electrical circuit is formed in the earbud 631 where the earbud wire connects the audio signal along the positive wire 661 to the driver unit 650 with a return negative wire 663 from to the speaker or driver unit 650 through the leaf spring contact 667. The positive wire 661 can also be configured to bypass the driver unit 650 through metal contact plate 669. The headphone 601 can have a metal contact 669 configured to connect with leaf spring contact 667 such as, for example, positioning the metal contact 669 adjacent an aperture in the earbud device 631, for diverting the ground or negative wire 663. The headphone 601 can have a magnet 670 as a second contact formed with a leaf spring 667 configured to connect leaf spring contact 667 and the metal contact 669 for diverting audio signal from the positive wire 661 such as, for example, similarly positioning the magnet 670 adjacent leaf spring contact 667 an aperture in the earbud device 631. When the connection 660 is closed or changed, the electrical circuit closes to divert the audio signal to the headphone 601 speaker 617 via the new connection between magnets 670 as well as leaf spring contact 667 and metal contact plate 669. When connection 660 is made between the earbud 631 and the headphone 601, the switch 665 opens and the audio signal is provided to headphone speaker 617, as is shown in FIG. 14B. In this manner, the connection 660 of the earbud 631 to the headphone 601 can control advantageously the headphone and earbud device 600.

Figure 16:
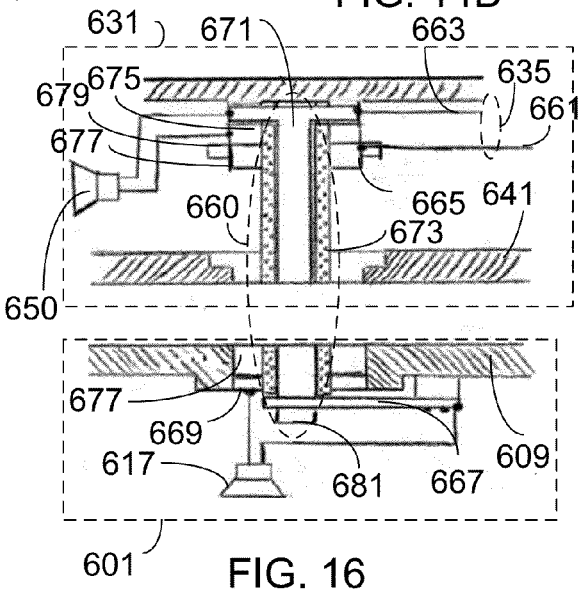
FIG. 16 is a schematic circuit diagram of the electronic switch assembly of another embodiment of the headphone and earbud assembly.

According to yet another alternative embodiment of the present invention as shown in FIG. 16, the connection 660 can be formed by an electro-mechanical connection configured with a switch 665 formed by a pin or T-pin 671 disposed in an insulating tube 673, a metal washer 675 and doughnut magnet disposed around the insulating tube 673 and positioned adjacent a aperture in the earbud device 631 forming one part of the connection 660. The metal washer 675 and doughnut magnet disposed are secured and held in place around the insulating tube 673 using retaining washer 679. A similar aperture is formed in the headphone 601 with another doughnut magnet 677 surrounding an insulator tube 673 and a steel pin 681 positioned adjacent the aperture so as to form a connection 660. In the headphone 601, the steel pin 681 connects to a leaf spring contact 667. An electrical circuit is formed in the earbud 631 where the earbud wire connects the audio signal along the positive wire 661 passing through the T-pin to the driver unit 650 with a return negative wire 663 from to the speaker or driver unit 650 passing through the metal washer. The positive wire 661 can also be configured to bypass the driver unit 650 through the attractive forces of the one or more doughnut magnets 670 connecting and forming a metal-to-metal contact. The doughnut magnets 670 are configured to attract and connect forming a circuit to the headphone 601, whereby the audio signal along the positive wire 661 passing through the T-pin 671 to the steel pin 681 connecting leaf spring contact 667 to the speaker 617 of the headphone 601. A return negative wire connects the speaker 617 to the metal contact 669 configured to conduct vial the connected doughnut magnets 677 to the metal washer 675. The aperture can have a suitable design form a suitable connection 660 when the doughnut magnets 677 attract closing the aperture connecting the earbud device 631 and headphone 601 When connection 660 is made between the earbud 631 and the headphone 601, the switch 665 opens and the audio signal is provided to headphone speaker 617, as is shown in FIG. 14B. In this manner, the connection 660 of the earbud 631 to the headphone 601 can control advantageously the headphone and earbud device 600.

Figure 17:
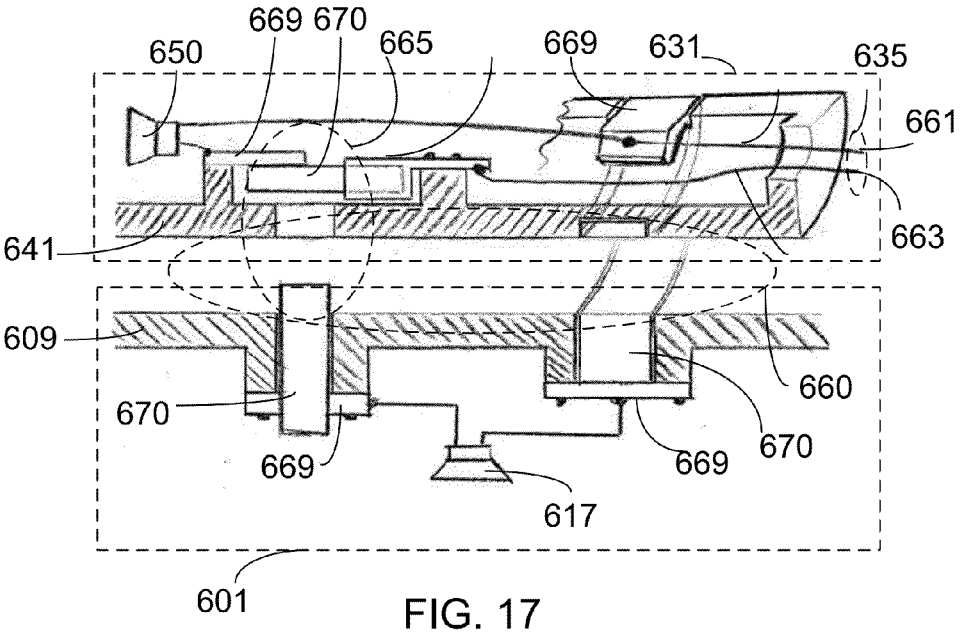
FIG. 17 is a schematic circuit diagram of the electronic switch assembly of yet another embodiment of the headphone and earbud assembly.

According to still yet another embodiment of the present invention as shown in FIG. 17, the connection 660 can be formed by an electro-mechanical connection configured with a leaf spring contact 667, such as can be formed from spring steel, configured in the earbud device 631, a metal contact 669 such as a metal or conductive plate, and one or more magnets 670 such as a permanent magnet. An electrical circuit is formed in the earbud 631 where the earbud wire connects the audio signal along the positive wire 661 to the driver unit 650 with a return negative wire 663 from to the speaker or driver unit 650 through the leaf spring contact 667. The positive wire 661 can also be configured to bypass the driver unit 650 through metal contact plate 669 that can be configured, for example, from a ribbon of sheet metal wrapped around the outside of the earbud device 631 to form a contact with the positive wire 661 via the magnet 670. The headphone 601 can have a metal contact 669 and magnet 670 configured to connect the speaker 617 such as, for example, positioning the magnet 670 adjacent the metal contact 669 wrapped around the earbud device 631. The headphone 601 can have a magnet 670 and contact 669 connected to the negative wire from the speaker 617. A second connection for the negative wire 663 can be formed using magnet 670 disposed adjacent an aperture in the earbud device 631 to connect with a magnet 670 contact formed with the leaf spring 667 and metal contact configured to connect leaf spring contact 667 and the metal contact 669 for passing the audio signal for the ground or negative wire 663, for example, similarly positioning the magnet 670 adjacent the magnet 670 that attracts and forms a connection with leaf spring contact 667 in an aperture in the earbud device 631. When the connection 660 is closed or changed, the electrical circuit closes to divert the audio signal to the headphone 601 speaker 617 via the new connection between magnets 670 as well as leaf spring contact 667 and metal contact plate 669. When connection 660 is made between the earbud 631 and the headphone 601, the switch 665 opens and the audio signal is provided to headphone speaker 617, as is shown in FIG. 14B. In this manner, the connection 660 of the earbud 631 to the headphone 601 can control advantageously the headphone and earbud device 600.

As is illustrated in FIGS. 14-18A-18B, the control of powering on and off of the headphone and earbud device 600 can advantageously be accomplished with use a magnetic reed switch, leaf switch, magnetic doughnut switch, or a protrusion switch in each earbud that activates when the magnet in the headphone is in proximity/contact. Magnetism may also be used for the mechanical connection component. As disclosed herein, various mechanical means are useful to form a connection 660 to click the earbud 631 to the headphone 601. The connection 660 of the headphone and earbud device 600 is useful in many style adaptations including, but not limited to, over-ear headphones, on-ear headphones, wireless/bluetooth headphones, gaming headphones, earmuff headphones, headband headphones, helmet headphones, or hat headphones. Alternatively, the connection 660 of the headphone and earbud device 600 can control wireless 637 earbud devices 631 that turn the system of the headphone and earbud device 600 into a wireless headphone and earbud device 600.

In operation, as is illustrated in FIGS. 7A, 7B, 9A, 9B, and 14-17, 1. A user connects the earbud(s) to the audio source (MP3 player, Tablet, Smartphone)
2. The user can put the earbuds directly in their ears to listen
3. To switch to the headphones, the user first removes the earbuds from their ears
4. Next, the user connects each earbud into its respective location on each headphone cup
5. At this point, the audio signal has been transferred to the headphone speakers, and the user wears the headphones to listen.

While certain configurations of structures have been illustrated for the purposes of presenting the basic structures of the present invention, one of ordinary skill in the art will appreciate that other variations are possible which would still fall within the scope of the appended claims. For example, spring loaded ball-bearings can be used as the mechanical connection component. The electrical connection from the earbud to the headphone can be designed so that contact plates on the earbud mate with contact plates on the interior recess of the headphone. Also, in the wired version, other potential uses for the wires that connect the earbud to headphone are envisioned such as, for example, wires controlling the power of the audio signal are also used to send DC power to headphone to power other elements such as Noise Cancellation, cosmetic LED lighting, or a headphone battery. If DC power is to be incorporated, other active features such as the noise cancellation and/or any cosmetic/passive features of, for example, a glowing LED design can be implemented. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A headphone and earbud device for receiving an audio signal, comprising:

a headphone including a speaker acoustic device to amplify the audio signal, with said speaker acoustic device comprising a speaker chamber positioned adjacent a user's ear and a loudspeaker configured to cooperate with an aperture in the headphone;

an earbud connected to said aperture in said headphone to transmit the audio signal to said speaker chamber; and an adaptive connection configured between said headphone and said earbud configured to controls playback of the audio signal to said loudspeaker in said headphone.

2. A device as claimed in claim 1, whereby the adaptive connection controls energization of the audio signal in the headphone so as to turn the audio signal on and off.

3. A device as claimed in claim 2, whereby the adaptive connection controls energization of the audio signal in said loudspeaker in the headphone so as to turn the audio signal on and off.

4. A device as claimed in claim 1, whereby the adaptive connection controls the audio signal in the headphone to increase and decrease the volume.

5. A device as claimed in claim 4, whereby the adaptive connection controls energization of the audio signal in a speaker in the headphone to increase and decrease the volume of the audio signal.

6. A device as claimed in claim 1, whereby the earbud includes a microphone.

7. A device as claimed in claim 6, whereby the adaptive connection controls energization of microphone associated with the headphone so as to mute and un-mute the audio signal.

8. A device as claimed in claim 1, wherein said adaptive connection is opened and closed by placing or removing said earbud in an aperture of said headphone.

9. A device as claimed in claim 8, wherein said adaptive connection includes positioning a doughnut magnet adjacent a seal, whereby said doughnut magnet is part of the electrical circuit being connected thereto to ground and said seal is constructed of conductive metal attracted to the doughnut magnet.

10. A device as claimed in claim 8, wherein said adaptive connection includes a headphone magnet positioned transversely in a hole of a headphone aperture assembly adjacent said doughnut magnet and adjacent a earbud magnet, whereby earbud magnet is positioned within a clip contact that interacts to connect an earbud speaker drive unit so as to energize said loudspeaker of said headphone.

11. A headphone and earbud system that intrinsically concentrates, amplifies, and efficiently transmits earbud audio signals to a user's ear, comprising:

a headphone including a speaker acoustic device, with said speaker acoustic device comprising a speaker chamber positioned adjacent a user's ear and a loudspeaker configured to cooperate with an aperture in the headphone;

at least one earbud detachably connected to said aperture in said headphone in close proximity to the user's ear canal to transmit audio signals to said loudspeaker through said aperture opening in the outside surface of said headphone and the other opening in close proximity to the user's ear canal; and an adaptive connection configured between said headphone and said earbud configured to control a playback of the audio signal.

12. A system as claimed in claim 11, wherein the earbud is magnetically connected to the speaker chamber.

13. A system as claimed in claim 11, wherein said adaptive connection is configured between the headphone and the earbud configured to control a playback of the audio signal.

14. A system as claimed in claim 11, whereby said adaptive connection controls energization of the audio signal in the headphone so as to turn the audio signal on and off.

15. A system as claimed in claim 11, whereby the adaptive connection controls energization of the audio signal in said loudspeaker in the headphone so as to turn the audio signal on and off.

16. A system as claimed in claim 11, whereby the adaptive connection controls the audio signal in the headphone to increase and decrease the volume.

17. A system as claimed in claim 6, whereby the adaptive connection controls energization of the audio signal in said loudspeaker in the headphone to increase and decrease the volume of the audio signal.

18. A system as claimed in claim 11, whereby the earbud includes a microphone.

19. A system as claimed in claim 16, whereby the adaptive connection controls energization of microphone in the headphone so as to mute and un-mute the audio signal.

20. A system as claimed in claim 11, wherein said adaptive connection is opened and closed by placing or removing said earbud in an aperture of said headphone.

* * * * *